US009886840B2

(12) United States Patent
Groves

(10) Patent No.: US 9,886,840 B2
(45) Date of Patent: Feb. 6, 2018

(54) METHOD FOR GUARANTEED DELIVERY OF ALERT NOTIFICATIONS THROUGH CHAIN-OF-COMMAND ESCALATION PROCEDURES

(71) Applicant: Rory Groves, Minneapolis, MN (US)

(72) Inventor: Rory Groves, Minneapolis, MN (US)

(73) Assignee: Groves Internet Consulting, Inc., Minneapolis, MN (US)

( * ) Notice: Subject to any disclaimer, the term of this patent is extended or adjusted under 35 U.S.C. 154(b) by 0 days.

(21) Appl. No.: 14/862,593

(22) Filed: Sep. 23, 2015

(65) Prior Publication Data

US 2016/0086473 A1 Mar. 24, 2016

Related U.S. Application Data

(60) Provisional application No. 62/054,130, filed on Sep. 23, 2014.

(51) Int. Cl.

| | |
|---|---|
| ***G08B 21/18*** | (2006.01) |
| ***G08B 25/00*** | (2006.01) |
| *G08B 21/10* | (2006.01) |

(52) U.S. Cl.

CPC ..... *G08B 25/005* (2013.01); *G08B 21/10* (2013.01)

(58) Field of Classification Search

None

See application file for complete search history.

(56) References Cited

U.S. PATENT DOCUMENTS

| | | | | |
|---|---|---|---|---|
| 7,353,023 | B1 * | 4/2008 | Link, II | H04W 4/14 455/414.2 |
| 2007/0088572 | A1 * | 4/2007 | Susai | G06Q 10/06 705/2 |
| 2007/0293240 | A1 * | 12/2007 | Drennan | H04L 12/189 455/456.1 |
| 2008/0046803 | A1 * | 2/2008 | Beauchamp | G06F 17/30563 715/212 |
| 2010/0287215 | A1 * | 11/2010 | Lasensky | G06Q 10/06 707/805 |
| 2010/0312852 | A1 * | 12/2010 | Kamga | H04L 67/2823 709/217 |
| 2010/0325065 | A1 * | 12/2010 | Lego | G06Q 40/00 705/36 R |
| 2014/0313032 | A1 * | 10/2014 | Sager | H04Q 9/00 340/539.17 |

(Continued)

OTHER PUBLICATIONS

Dell Inc.; Dell Crisis Management & Alerting FAQs; Website; 2014; http://www.dell.com/content/topics/global.aspx/services/saas/crisis_management_faq?c=us&l=en&cs=04#What%20services%20are.

(Continued)

*Primary Examiner* — Quan-Zhen Wang
*Assistant Examiner* — Chico A Foxx
(74) *Attorney, Agent, or Firm* — Grumbles Law PLLC; Brittany Nanzig

(57) ABSTRACT

Computer (server)-based system for detecting anomalous data patterns and generating alert notifications and guaranteeing delivery by soliciting acknowledgement by end-users. If acknowledgement is not obtained within a pre-determined timeframe, the notification is escalated to managing authority and the process repeats until acknowledgement is obtained or the full chain of command is exhausted.

8 Claims, 8 Drawing Sheets

(56) References Cited

U.S. PATENT DOCUMENTS

2014/0327547 A1* 11/2014 Johnson ..... H04L 12/1895
340/601
2015/0025790 A1* 1/2015 Hwang ..... G08B 25/10
701/411

OTHER PUBLICATIONS

National Weather Service Inc.; InteractiveNWS; Website; Sep. 2014; http://inws.wrh.noaa.gov.

* cited by examiner

METHOD FOR GUARANTEED DELIVERY OF ALERT NOTIFICATIONS THROUGH CHAIN-OF-COMMAND ESCALATION PROCEDURES

CROSS-REFERENCE TO RELATED APPLICATION

This application claims the benefit of U.S. Provisional Application No. 62/054,130, filed Sep. 23, 2014, titled METHOD FOR GUARANTEED DELIVERY OF ALERT NOTIFICATIONS THROUGH CHAIN-OF-COMMAND ESCALATION PROCEDURES.

FIELD OF THE DISCLOSURE

The disclosed invention relates to a system used to detect anomalous patterns, report to a centralized authority utilizing electronic methods, and providing escalating levels of disclosure until the alert is acknowledged.

BACKGROUND OF THE INVENTION

A critical problem exists within the risk management and mitigation departments of larger organizations. To maximize safety and/or business continuity, managers need to be alerted to hazardous events, such as inclement weather, security breaches, or network outages, as early as possible. In the case of severe weather, minutes could mean the difference between life and death. But early warning comes at a cost; too many false positives eventually lead managers to ignore the warnings, defeating the purpose of an alerting system altogether. This is compounded by the fact that most organizations, in an attempt to maximize awareness of hazardous events (and perhaps limit liability), will send alerts to a larger than needed number of recipients. As a result, no one individual takes responsibility for responding, resulting in communication breakdowns and unnecessary delays. While some of these issues can be addressed through policies and procedures, such rules can be difficult to enforce during an emergency situation. Finally, external circumstances such as power outages or network interruptions may delay or prevent alerts from reaching their intended audience.

An effective early-warning alerting system should thereby: 1) communicate only relevant alerts to the minimum possible number of recipients, 2) guarantee receipt of said alerts, 3) automatically escalate alerts which are not acknowledged in a timely fashion, and 4) provide auditing controls for post-event evaluation. The system described herein would encompass all aspects of an effective early-warning alerting system.

SUMMARY OF THE INVENTION

Computer (server)-based system for detecting anomalous data patterns and generating alert notifications and guaranteeing delivery by soliciting acknowledgement by end-users. If acknowledgement is not obtained within a pre-determined timeframe, the notification is escalated to managing authority and the process repeats until acknowledgement is obtained or the full chain of command is exhausted.

DETAILED DESCRIPTION

Figure 1:
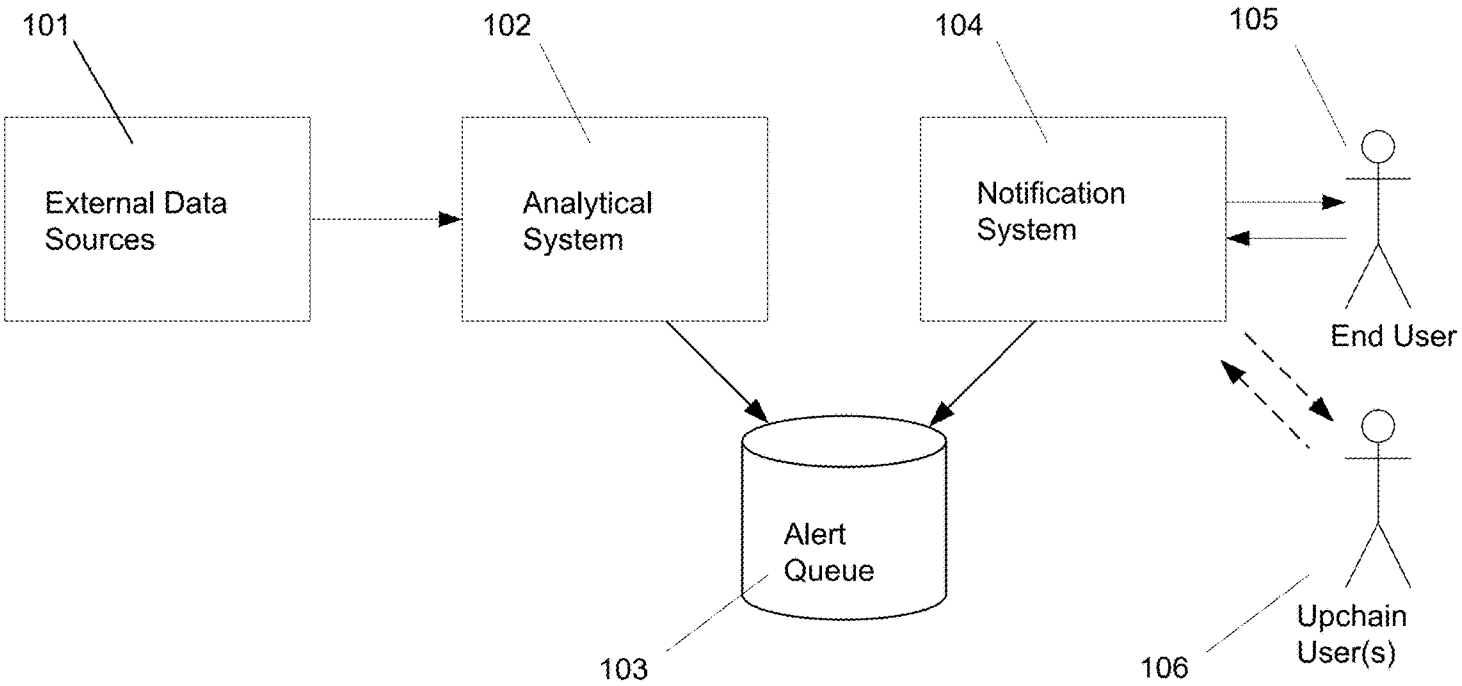
FIG. 1 illustrates a flow diagram of one embodiment of the disclosed system.

Various user interfaces and embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. It is understood that various omissions and substitutions of equivalents are contemplated as circumstances may suggest or render expedient, but these are intended to cover application or embodiments without departing from the spirit or scope of the claims attached hereto. Also, it is to be understood that the phraseology and terminology used herein are for the purpose of description and should not be regarded as limiting.

Figure 2:
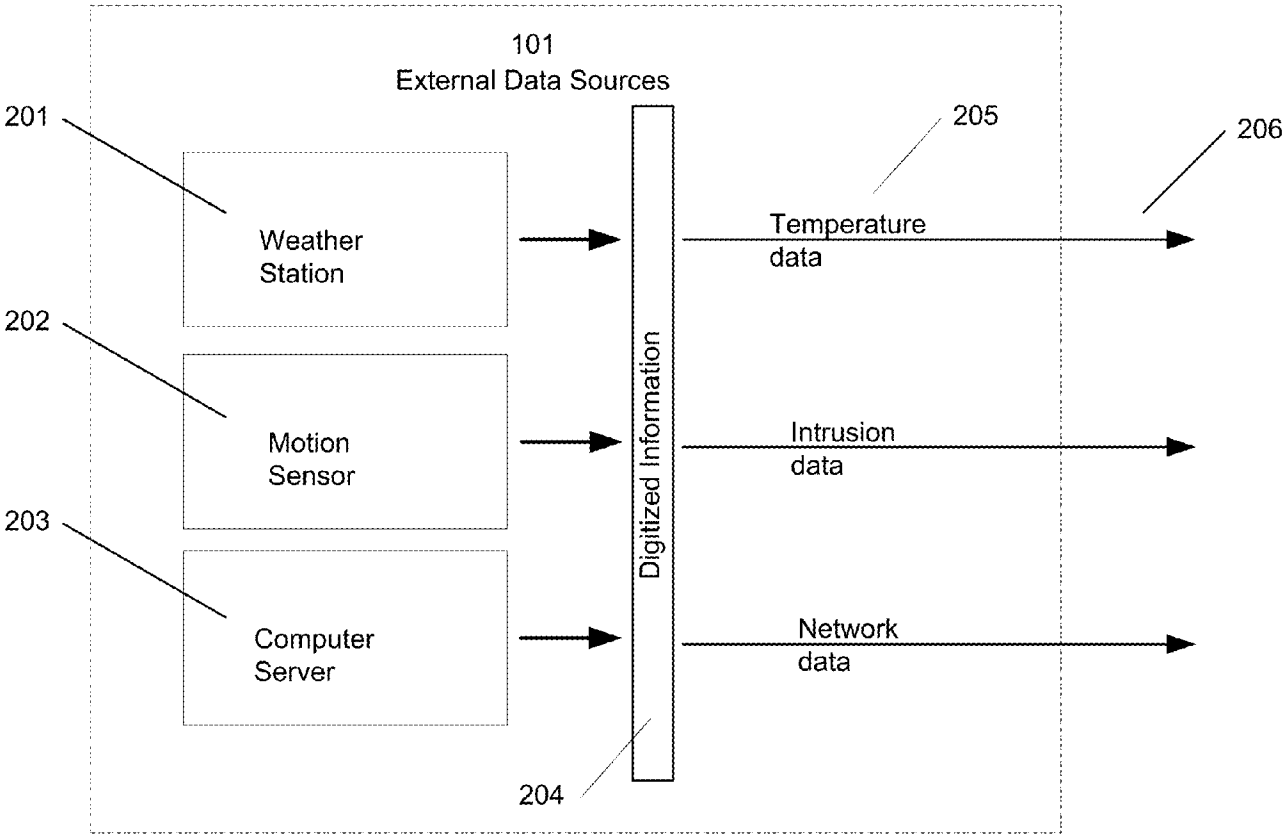
FIG. 2 illustrates an information flow according to one embodiment of the disclosed system.
Figure 3:
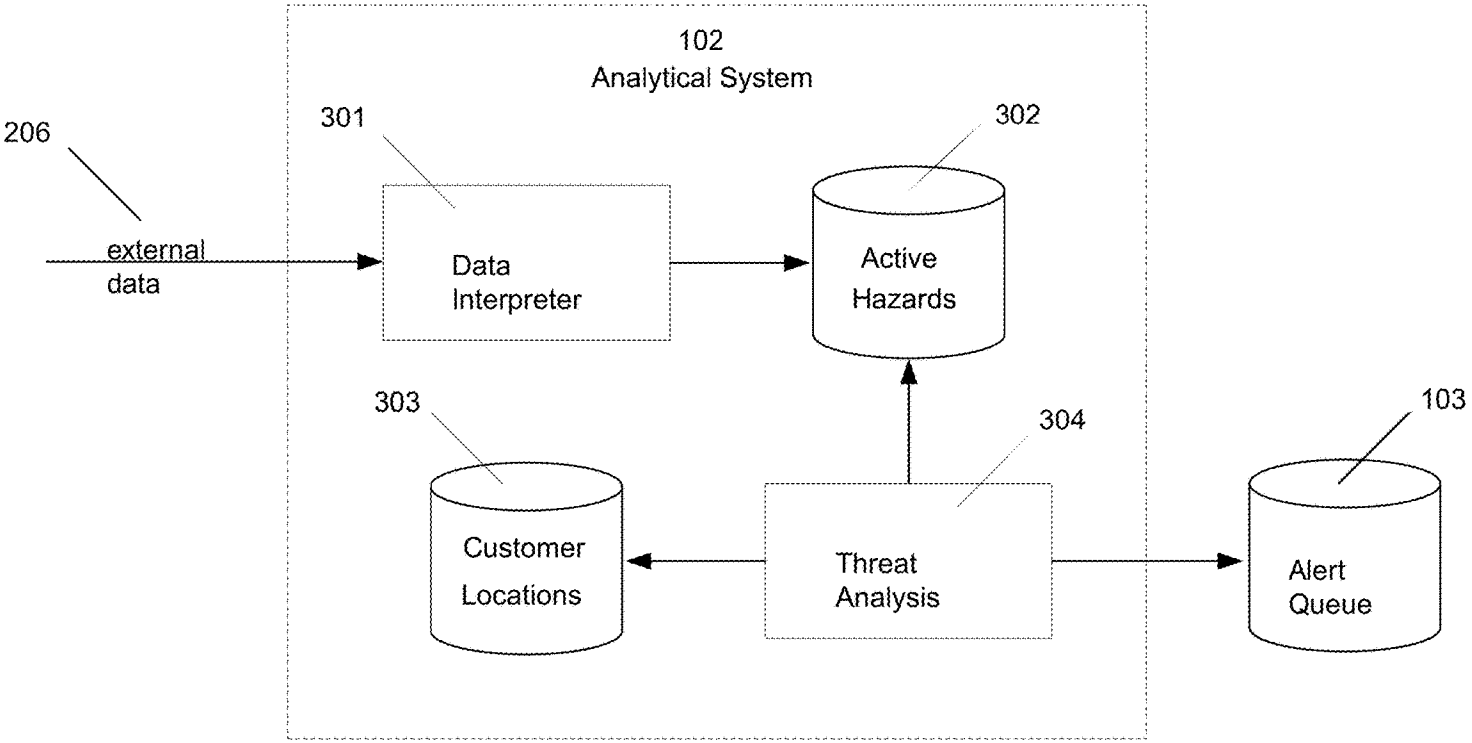
FIG. 3 is a schematic block diagram depicting an example analytical system used to detect anomalous data patterns in accordance with one embodiment of the present invention.
Figure 4:
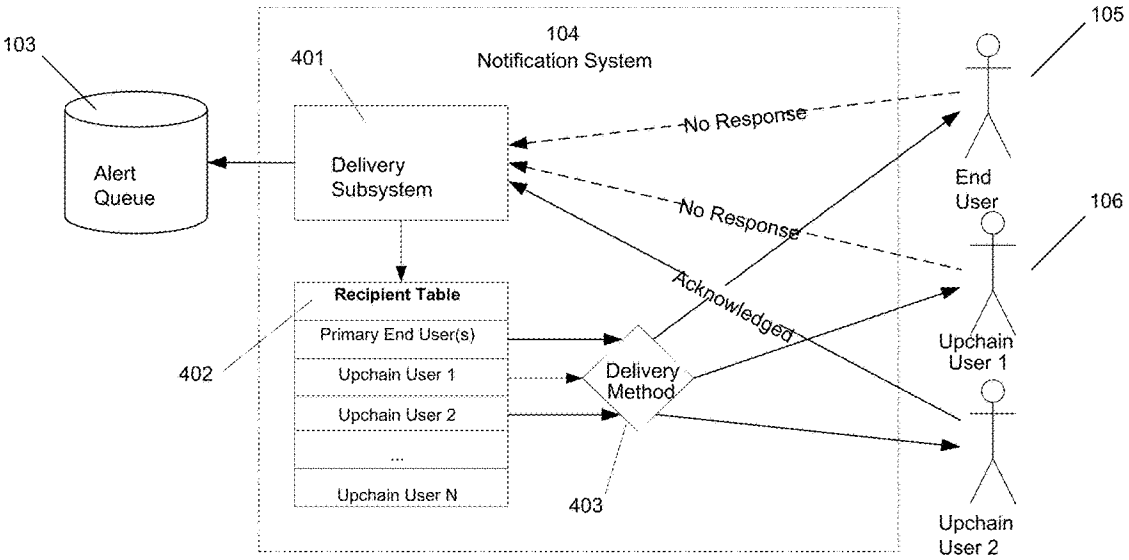
FIG. 4 illustrates a notification schema of one embodiment of the disclosed system.

FIG. 1 illustrates a high level diagram for the system. In one embodiment, as illustrated in FIG. 2, External Data Sources [101] represents one or more sources of data representing real-world events made digitally available to computer systems. Certain events represent a hazard for which the End User [105] would want to be notified in a timely manner. Such hazards may include, but are not limited to inclement weather, physical security breaches, or computer network interruptions. As illustrated in FIG. 3, Analytical System [102] represents software and hardware configurations designed to monitor data from External Data Sources [101] and analyze whether it represents an alertable condition (hazard) to the End User [105]. The End User [105] represents an individual or group of individuals who are configured to receive alerts from the system. If an alertable condition is met, the Analytical System [102] creates a notification instruction in the Alert Queue [103], which is subsequently processed by the Notification System [104]. As illustrated in FIG. 4, the Notification System [104] represents software and hardware configurations designed to deliver alert notifications to one or more End Users [105]. Notification System [104] may use any method for delivering alerts to the End User [105] including, but not limited to, e-mail, SMS text, or smartphone application.

Upon receipt of notification, the End User [105] will acknowledge receipt back to the Notification System [104]. In the case of multiple simultaneous End Users [105], the first person to acknowledge the notification will satisfy the solicitation. The method of acknowledgement depends upon the method of delivery. In the case of e-mail delivery, the End User [105] may be requested to click a hyperlink embedded within the e-mail. In the case of a smartphone application, the End User [105] may be requested to push a button displayed alongside the alert.

If the End User [105] does not acknowledge the alert within a specified timeframe, the Notification System [106] will re-issue the notification to the designated Upchain User [106]. The Upchain User [106] represents an individual or group of individuals that for the purposes of this system is acting in a supervisory capacity to the End User [105]. If the Upchain User [106] also does not acknowledge the alert, the Notification System [104] will re-issue the notification once more to another Upchain User and repeat the process until someone acknowledges receipt of alert or the full chain of command is exhausted.

External Data Sources [101] may be represented as a Weather Station [201] collecting temperature, wind, humidity and precipitation information. Device readings are then translated into digital information [204] so as to be accessible by computer information systems [205]. This data is then uploaded to public repositories to be accessed by external computer systems [206].

Other examples of External Data Sources [101] may include, but are not limited to home security Motion Sensors [202] and Computer Server [203] uptime monitors. Any source of real-world events that can be translated into digital information would be compatible with the Chain of Command notification system.

In the Analytical System [102], external data [206] is received by the Data Interpreter [301], which translates the data from its native format into a common format used by the system. The data is then stored internally in an Active Hazards [302] database. Threat Analysis [304] represents computer algorithms designed to compare Active Hazards [302] with Customer Locations [303] and determine if an alertable condition exists. An example of an alertable condition could be temperatures dropping below 32° F. within 5 miles of a Customer Location [303]. If an alertable condition exists, Threat Analysis [304] algorithms create a notification instruction in the Alert Queue [103].

The Notification System [104] is responsible for guaranteeing delivery of alert messages to designated End User(s) [105]. The Delivery Subsystem [401] polls the Alert Queue [103] for new notifications waiting to be sent. Notification instructions are populated in the Alert Queue [103] by the Analytical System [104]. Upon discovery of a new alert, the Delivery Subsystem [401] prepares a notification message as follows. First the Delivery Subsystem [401] consults the Recipient Table [402] to determine who should receive the message. The Recipient Table [402] contains at least one End User [105] and may include one or more up-chain users [106] operating in a supervisory capacity to the primary End User [105]. After the recipient has been identified, the Delivery Method [403] is determined based on that user's preferences. Delivery Methods [403] may include, but are not limited to, e-mail, SMS text, or smartphone applications. Finally, the notification message is sent to the End User [105]. In some cases, the organization may wish to notify multiple End Users [105] simultaneously. Embedded within each Delivery Method [403] is a method for acknowledging the receipt of the alert notification. If the primary End User [105] does not acknowledge receipt within a specified timeframe the Delivery Subsystem [401] will initiate another alert to be sent to an up-chain user, as defined in the Recipient Table [402]. A Delivery Method [403] will be determined and the second alert message is sent to the up-chain user [106] or group of users. The process of sending alert notifications to Upchain Users [106] is repeated until someone acknowledges receipt or the Recipient Table [402] is exhausted and all contacts have been notified.

Figure 8:
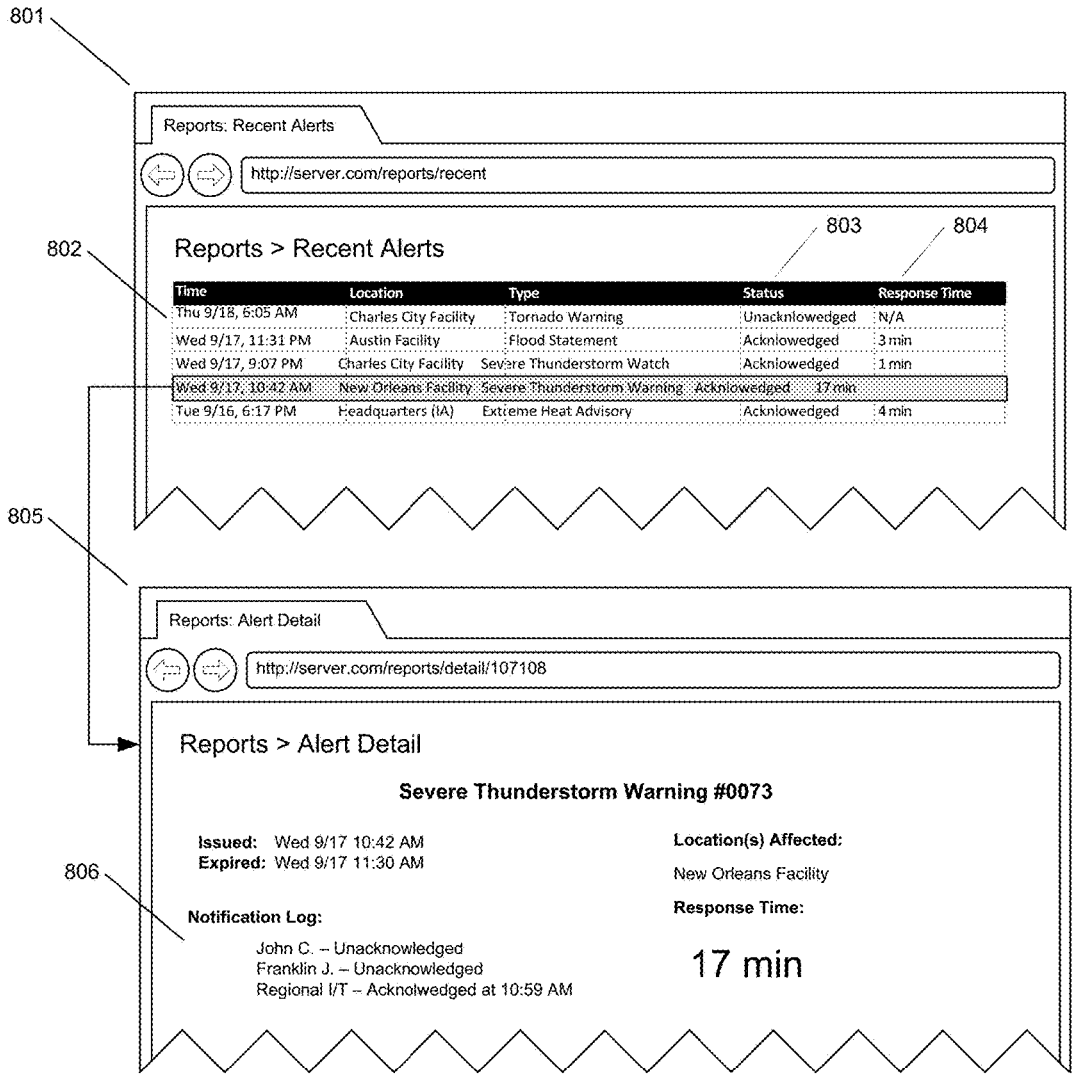
FIG. 8 illustrates reporting and auditing controls according to one embodiment of the disclosed system.

All interaction between End Users [105], Upchain Users [106], and the Delivery Subsystem [401] are recorded internally for future reporting. In the case of failed alert delivery, such reporting would provide managers the ability to discover the reason for communication breakdowns, as illustrated in FIG. 8.

Figure 5:
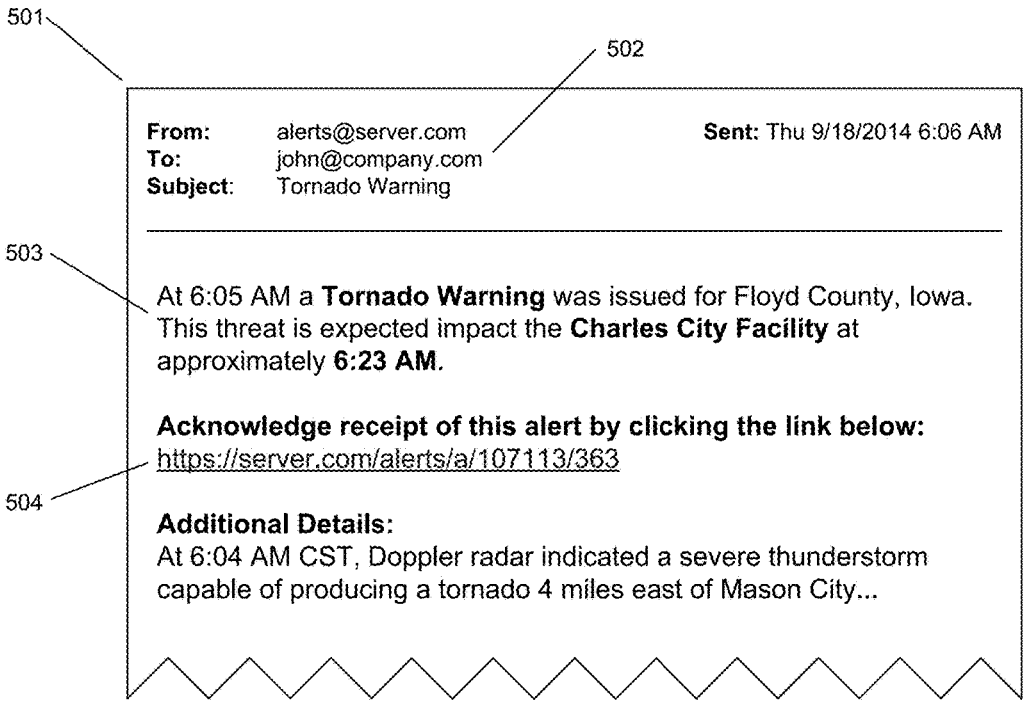
FIG. 5 illustrates a message alert received by email according to one embodiment of the disclosed system.

The End User [105] may receive a weather-related alert via e-mail delivery, as illustrated in FIG. 5. The E-mail message [501] is sent by the Notification System [104] to the end user's e-mail address [502], which can be retrieved by any desktop or web-based software capable of displaying e-mail messages. A brief description [503] about the hazardous event is followed by an embedded hyperlink [504], which the End User [105] is requested to click to acknowledge receipt of the alert.

Figure 6:
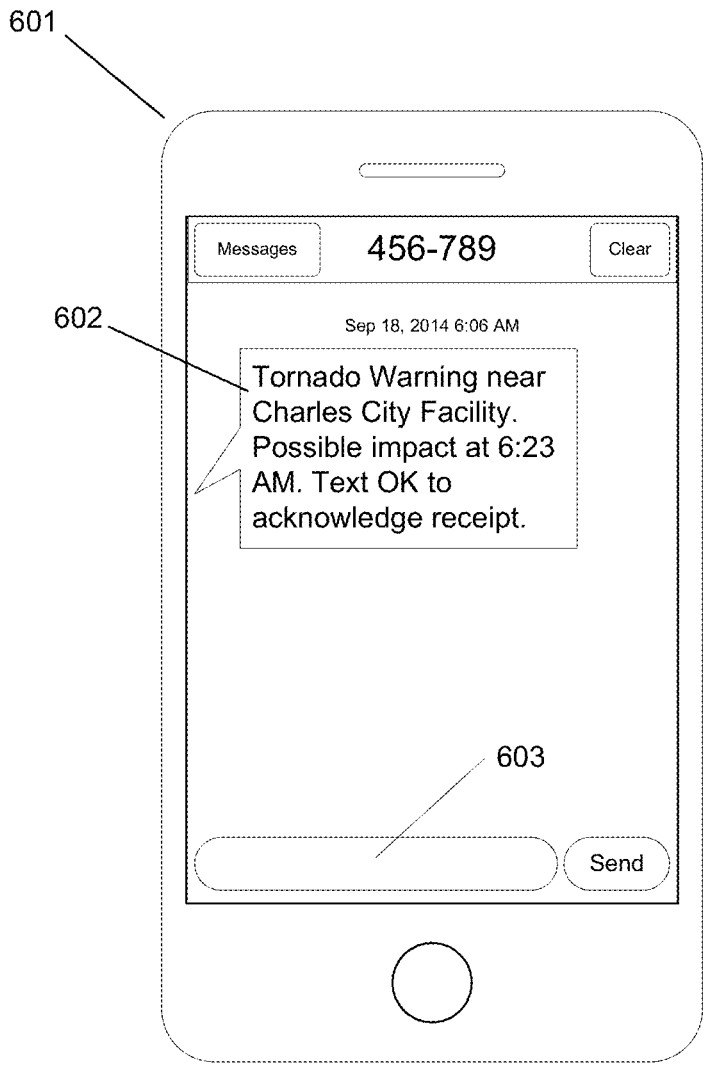
FIG. 6 illustrates a message alert received by SMS Text according to one embodiment of the disclosed system.

The End User [105] may receive a weather-related alert via Short Messaging Service (SMS), as illustrated in FIG. 6. A cellular phone running SMS software [601] will display alerts sent by the Notification System [104] to the end user's phone number. Due to size limitations, the message body [602] in a SMS text will be shorter than in other delivery methods such as e-mail. Instructions are provided for the End User [105] to acknowledge receipt by sending a reply text [603] back to the Notification System [104].

Figure 7:
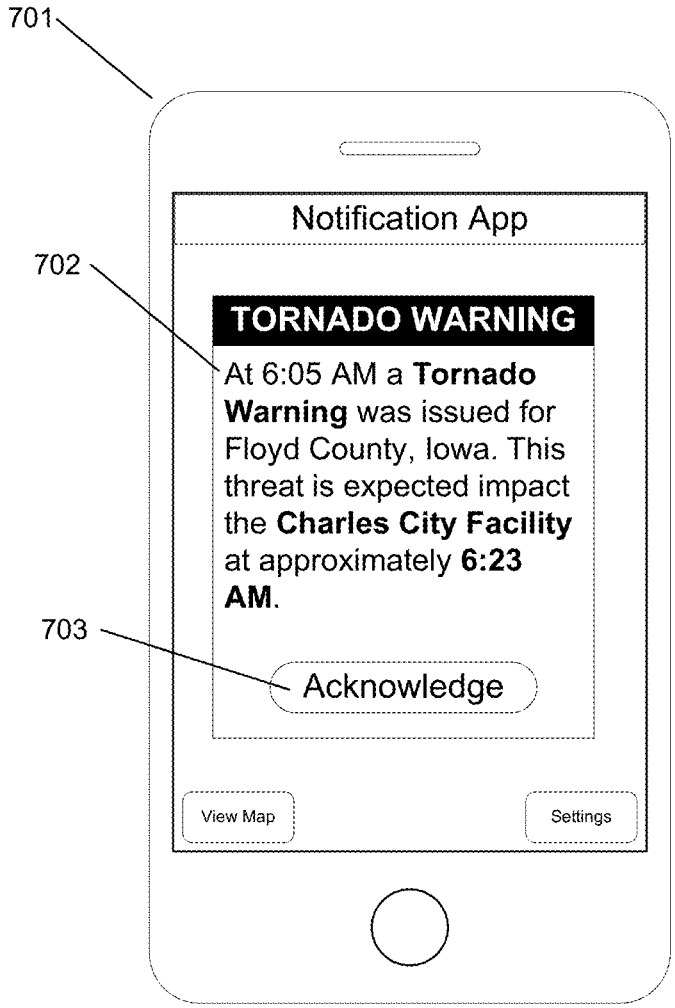
FIG. 7 illustrates a message alert received by an application running on a Smartphone device according to one embodiment of the disclosed system.

In a different embodiment of the invention, a smartphone running notification software [701] is capable of receiving push notifications from the Notification System [104], as illustrated in FIG. 7. When a notification is received by the software, a pop-up alert [702] is displayed on the end user's screen describing details about the threat along with a button [703] to acknowledge the notification has been received and read.

In the examples above, details about alerts issued by the Notification System [104] are presented through a web-based reporting interface [801, 805], as illustrated in FIG. 8. These reports provide managers the ability to audit performance of the overall system. A summary of recent alerts [802] provides a quick reference of active threats to the organization, including a status of acknowledgement [803] and response times [804] between the time the alert was issued and the first acknowledgement was received by an End User [105]. The details of a specific alert can be viewed on a separate screen [805] including a notification log [806] of all End Users [105, 106] who received alerts, in order of escalation, along with their acknowledgement status.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A data pattern and alert notification escalation system for managing hazardous event responses by organizations having multiple layers of management and geographically dispersed assets, the system comprising:

external data sources representing sources of data from real-world events made digitally available to the system, wherein the external data sources include a weather monitoring system and a physical security system;

an analytical system comprising software and hardware configurations in a computer server-based system, wherein the analytical system monitors data from the external data sources, analyzes the data from the external data sources, and creates a notification instruction;

an alert queue database that stores the notification instruction;

a notification system comprising software and hardware configurations in the computer server-based system, wherein the notification system is configured to:

(a) process the notification instruction to determine one or more primary end users and one or more up-chain users to classify as recipients of the processed notification instruction, wherein:

the one or more primary end users are a lowest-tier authority;

the one or more up-chain users is acting in a supervisory capacity to the one or more primary end users;

the one or more recipients belong to a single organization; and the end users are geographically dispersed with corresponding mobile devices, respectively;

(b) send the processed notification instruction, for reception, to at least one of the corresponding mobile devices to receive an acknowledgement receipt of the processed notification instruction;

(c) receive the acknowledgment receipt from the at least one mobile device of the corresponding mobile devices when a respective one or more primary end users confirms the receipt of the processed notification instruction;

(d) wait a predetermined length of time after the processed notification instruction is sent to the at least one mobile device of the corresponding mobile devices and, if the acknowledgement receipt has not been received, escalate and reissue the processed notification instruction to a first additional mobile device of the corresponding mobile devices;

(e) receive the acknowledgement receipt from the first additional mobile device of the corresponding mobile devices when a respective one or more up-chain end users confirms the receipt of the processed notification instruction;

(f) wait the predetermined length of time and, if the acknowledgement receipt has not been received from the first additional mobile device of the corresponding mobile devices, escalate and reissue the processed notification instruction to a second additional mobile device of the corresponding mobile devices of an additional one or more up-chain users, respectively, wherein the respective additional one or more up-chain users is acting in a supervisory capacity to the respective one or more up-chain end users;

(g) receive the acknowledgment receipt from the second additional mobile device of the corresponding mobile devices when the respective additional one or more up-chain end users confirms the receipt of the processed notification instruction; and (h) repeat steps (f) and (g) for additional one or more up-chain users, respectively, until an acknowledgement receipt event, for a respective recipient, corresponding to receipt of the acknowledge receipt within a respective wait of the predetermined length of time is received or until an event that all recipients' mobile devices of the corresponding mobile devices have, respectively, been sent the processed notification instruction, according to whichever respective event occurs first; and a web-based reporting interface in the computer server-based system for providing audit reports for post-event evaluation, wherein the interface is configured to:

record and store the recipients to whom the processed notification instruction was sent;

determine and store an acknowledgment receipt status for each recipient; and record and store a response time, the response time being an amount of elapsed time between a time of the processed notification instruction being respectively sent and a time of the acknowledgement receipt received, respectively.

2. The system of claim 1, wherein the external data source weather monitoring system is a weather station collecting weather information.

3. The system of claim 2, wherein the analytical system includes an active hazards database that stores the data from the external data sources.

4. The system of claim 3, wherein the analytical system includes a threat analysis system in the computer server-based system that compares the active hazards database to a customer location to determine if an alertable condition exists.

5. The system of claim 4, wherein the analytical system is configured to create the notification instruction when the alertable condition exists.

6. The system of claim 5, wherein the at least one of the one or more up-chain users is a group of users.

7. The system of claim 5, wherein the additional one or more up-chain users is a group of users.

8. The system of claim 1, wherein the physical security system is a motion sensor system.

* * * * *